US006160486A

United States Patent [19]

Niedermeyer

[11] Patent Number: 6,160,486

[45] Date of Patent: Dec. 12, 2000

[54] SERVICE ALARM MONITOR

[76] Inventor: Karl O. Niedermeyer, 17W068 North St., Bensenville, Ill. 60106

[21] Appl. No.: 09/299,159

[22] Filed: Apr. 22, 1999

[51] Int. Cl.[7] ..... G08B 3/00

[52] U.S. Cl. ..... 340/691.7; 340/540; 340/612; 340/616; 340/691.1; 340/815.4

[58] Field of Search ..... 340/691.7, 612, 340/618, 623, 603, 624, 628, 691.1, 691.3, 691.6, 692, 815.4

[56] References Cited

U.S. PATENT DOCUMENTS 1,216,678 2/1917 Ford ..... 340/612

4,841,282 6/1989 Reis ..... 340/612

*Primary Examiner*—Nina Tong

*Attorney, Agent, or Firm*—Lee, Mann, Smith, McWilliams, Sweeney & Ohlson

[57] ABSTRACT

A system for visually indicating activation of an alarm, even if the alarm is no longer activated. The system has a moveable visual indicator having an elongated shaft with a stop at one end, the shaft extending through a guide mounted on the alarm. A magnet on the stop temporarily affixes the visual indicator to the alarm until the alarm is activated, at which time the visual indicator separates from the alarm and falls vertically to protrude from the guide, indicating that the alarm has been activated.

16 Claims, 1 Drawing Sheet

SERVICE ALARM MONITOR

BACKGROUND OF THE INVENTION

This invention relates to alarm systems, and in particular to an alarm for visually indicating activation of an alarm, even if the alarm is no longer being activated.

The invention is particularly suitable for use with sump pumps, and even more particularly for use with auxiliary sump pumps which are employed to supplement a sump pump, since all sump pumps eventually fail. The invention can also be used in combination with a combined smoke and water level alarm to provide an indication of activation of the alarm, even if the alarm was activated in the absence of human monitoring and the activation has since ceased. This could be due to a low battery signal, which has ceased because the battery is completely drained.

Sump pumps have finite lives, and even while a sump pump maybe perfectly serviceable, if there is a power failure, even the best sump pump is of no value. Also, if a sump pump becomes wholly or partially clogged for any reason, its value is diminished. Thus, often battery-operated auxiliary sump pumps are employed to back up an electrically operated sump pump which fails to operate for any reason, or fails to handle the quantity of water entering the sump pit.

Often the sump pit is located in a basement in proximity to other mechanical equipment, such as a furnace. In many instances, a smoke alarm is employed in the vicinity of such equipment, and the smoke alarm can be combined with a water level alarm in the sump pit so that the alarm will generate a signal responsive to either smoke or an abnormal water level in the sump pit, or a low battery condition in the alarm.

SUMMARY OF THE INVENTION

The invention relates to a system for visually indicating activation of an alarm, where the alarm has a vibratory member (such as an alarm buzzer) which is activated in response to an alarm condition. The system comprises a moveable visual indicator, the indicator having an elongated shaft and a stop at a proximal end of the shaft. A guide is mounted on the alarm and shaped for directing movement of the visual indicator. Means is provided on the stop for temporarily affixing the visual indicator to the vibratory member with at least part of the shaft shrouded until the vibratory member is activated.

In accordance with the preferred form of the invention, the visual indicator includes a mark representative of an alarm condition. The mark can comprise a coloration of a portion of the elongated shaft, a different surface on that portion of the elongated shaft, or both. The mark can also comprise simply a longer portion of the shaft which is exposed than would otherwise have been exposed.

For temporarily affixing the visual indicator to the vibratory member, a magnet is located on the stop, with the magnet adhering to the vibratory member or to a metallic point which is secured to the vibratory member.

The guide comprises a depending sleeve surrounding the elongated shaft. A housing is employed for the visual indicator, as well, with the sleeve extending from the housing. The stop has a greater diameter than the diameter of the sleeve, thus preventing the visual indicator from falling from the housing.

BRIEF DESCRIPTION OF THE DRAWING

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
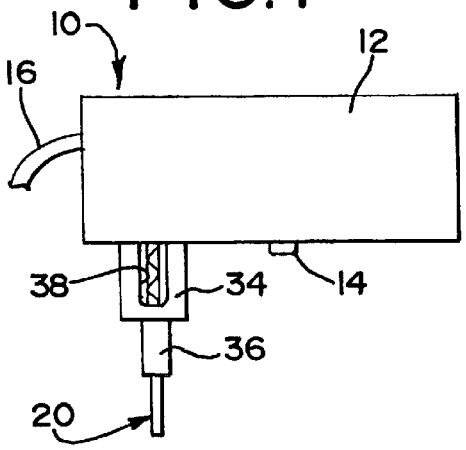
FIG. 1 is an elevational illustration of an alarm according to the invention, with the visual indicator undeployed.

A system according to the invention is designated generally at 10 in FIG. 1. The system 10 includes an alarm device 12, which can be a conventional alarm, such as a smoke alarm, and is therefore not illustrated in complete detail. The alarm device 12 includes a test button 14 which can be periodically depressed by the user to activate the alarm device to test its viability and the strength of the battery powering the alarm device 12. Preferably also, the alarm device 12 has a dual purpose, operating also as a water level alarm, and being connected to a conventional water level switch (not illustrated) by means of a line 16. Thus, the alarm device 12 will serve the dual purpose of a smoke detector and a water level detector.

The alarm device 12 includes a conventional audible signal alarm 18 which, when activated, not only emits a piercing signal, but also, due to its nature, vibrates. Often, however, the alarm device 12 may be activated due to an alarm condition, but then silenced when the alarm condition no longer exists. This can be when smoke is temporarily encountered, but is later cleared, or when an abnormal water level is experienced, such as when excess water is encountered or the pump is partially clogged, but the water is then later removed by a sump pump. In these instances, although the alarm device 12 will have been activated, in the past, there has been no reliable way of determining that it has, indeed, been activated.

The invention includes a moveable indicator 20 having an elongated shaft 22 and a stop 24 at a proximal end of the shaft 22. The shaft 22 includes a mark 26 occupying at least a part of the length of the shaft 22. The mark can comprise a coloration of that portion of the shaft, a different surface texture for that portion of the shaft, or any other indication on the shaft which is different from the rest of the shaft.

For temporarily fixing the visual indicator 20 to the audible signal alarm 18, a magnet 28 is secured to the top of the stop 24. If the body of the audible signal alarm 18 is metal, the magnet 28 can adhere directly to the audible signal alarm 18. However, often attraction of the magnet 28 to the alarm 18 is too robust, and even if the alarm 18 is activated, the magnet will not release reliably, as desired. In that instance, a metallic point 30, such as a ball or the like, can be mounted in a holder 32 on the alarm 18 to assure reliable release of the magnet 28 from the point 30 when the alarm 18 is activated.

Figure 2:
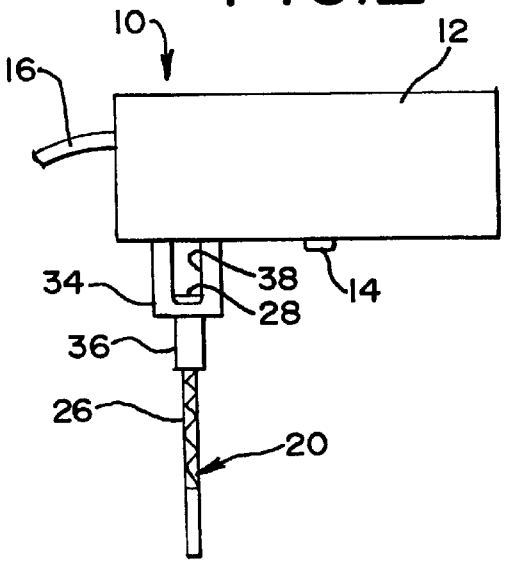
FIG. 2 is an elevational illustration similar to FIG. 1, but with the visual indicator deployed.

The visual indicator 20 extends through a housing 34, protruding from an integral sleeve 36 at the bottom of the housing 34. As illustrated, the sleeve 36 has a diameter slightly larger than that of the shaft 22, but smaller than that of the stop 24, so that when the visual indicator 20 drops under the influence of gravity in the housing 34, it does not fall completely through the sleeve 36. As illustrated in FIGS. 1 and 2, the housing 34 can include one or more ports 38 to aid in viewing of the visual indicator 20.

Figure 3:
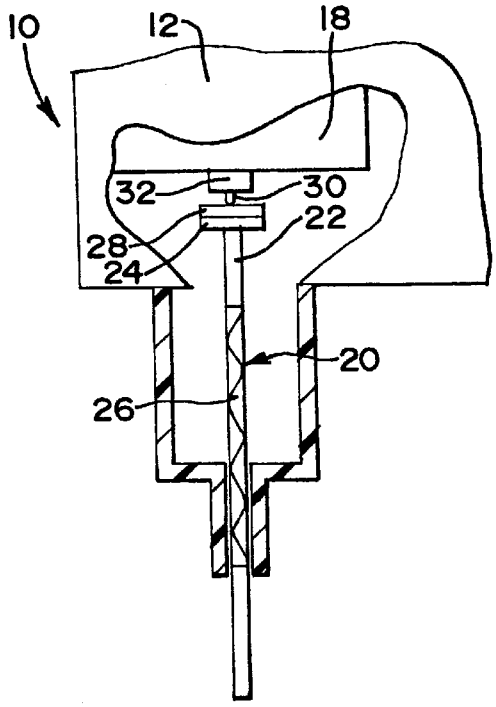
FIG. 3 is an enlarged fragmentary view of a portion of the alarm of FIG. 1, with portions broken away and in cross section to illustrate detail.
Figure 4:
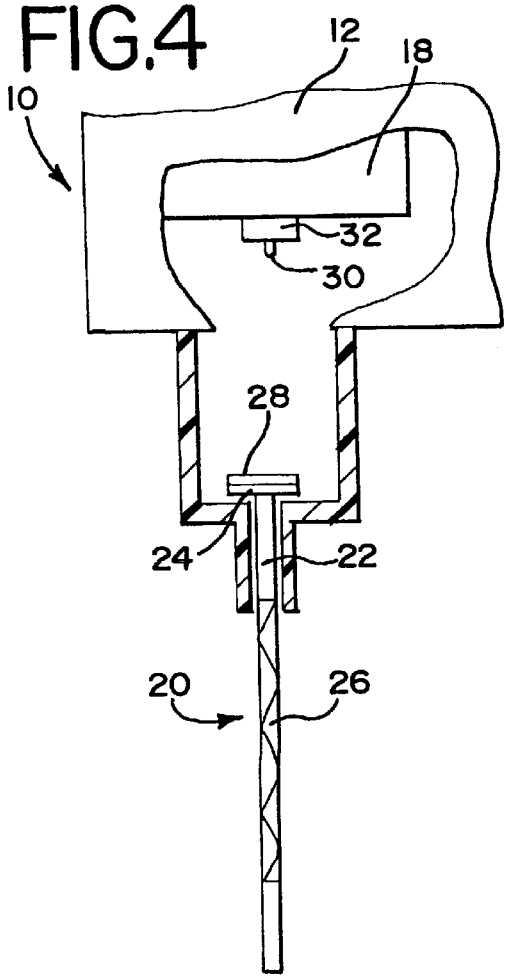
FIG. 4 is an enlarged fragmentary view of a portion of the alarm of FIG. 2, with portions broken away and in cross section to illustrate detail.

In a normal orientation, before the alarm device 12 has been activated, the visual indicator 20 is in the position illustrated in FIGS. 1 and 3, with the magnet 28 adhering to the metallic point 30. When the audible signal alarm 18 is activated for any reason, however, vibration of the alarm 18 separates the magnet 28 from the metallic point 30, and the visual indicator 20 falls under the influence of gravity to the orientation illustrated in FIGS. 2 and 4. In that instance, the mark 26 is clearly visible, as well as the additional length of the visual indicator 20 extending from the sleeve 36, giving the user a visual record that the alarm device 12 has been activated, even if the alarm device 12 is no longer being activated. Thus, whether activation of the alarm device 12 is due to smoke, an abnormal water level in a sump pit, or any other reason, a visual indication will always remain, even if the alarm condition no longer exists. The visual indication will also tell the user that, depending on what caused the visual indicator 20 to drop, no energy is being consumed other than, of course, the internal battery of the alarm device 12.

Various changes can be made to the invention without departing from the spirit thereof or scope of the following claims.

What is claimed is:

1. A system for visually indicating activation of an alarm which includes a vibratory member which is activated in response to an alarm condition, the system comprising a. a movable visual indicator, said visual indicator having an elongated shaft and a stop at a proximal end of said shaft, b. a guide mounted on said alarm and shaped for directing movement of said visual indicator, and c. means on said stop for temporarily affixing said visual indicator to said vibratory member with at least part of said shaft shrouded until said vibratory member is activated, with activation of said vibratory member causing separation of said visual indicator from said vibratory member.

2. A system according to claim 1 in which said visual indicator includes a mark representative of an alarm condition.

3. A system according to claim 2 in which said mark comprises coloration of a portion of said elongated shaft.

4. A system according to claim 1 in which said means for temporarily affixing comprises a magnet on said stop, the magnet adhering to said vibratory member.

5. A system according to claim 4 including a metallic point secured to said vibratory member, said magnet adhering to said metallic point.

6. A system according to claim 1 in which said guide comprises a depending sleeve surrounding said elongated shaft.

7. A system according to claim 6 including a housing attached to said alarm, said sleeve extending from said housing.

8. A system according to claim 6 in which said stop has a greater diameter than said sleeve.

9. A system according to claim 1 in which said vibratory member comprises an audible signal device.

10. A system for visually indicating activation of an audible alarm of an alarm device when activated in response to an alarm condition, the system comprising a. a housing depending from said alarm device, b. a movable visual indicator extending from said housing, said visual indicator having an elongated shaft and a stop at a proximal end of said shaft, c. a guide mounted on said housing and shaped for directing vertical movement of said visual indicator, and d. means on said stop for temporarily affixing said visual indicator to said audible alarm with at least part of said shaft shrouded until said audible alarm is activated, with activation of said audible alarm causing separation of said visual indicator from said audible alarm.

11. A system according to claim 10 in which said visual indicator includes a mark representative of an alarm condition.

12. A system according to claim 11 in which said mark comprises coloration of a portion of said elongated shaft.

13. A system according to claim 10 in which said means for temporarily affixing comprises a magnet on said stop, the magnet adhering to said audible alarm.

14. A system according to claim 13 including a metallic point secured to said audible alarm, said magnet adhering to said metallic point.

15. A system according to claim 10 in which said guide comprises a depending sleeve surrounding said elongated shaft.

16. A system according to claim 15 in which said stop has a greater diameter than said sleeve.

* * * * *